United States Patent [19]

Herman

[11] 4,070,728

[45] Jan. 31, 1978

[54] VERTICALLY ADJUSTABLE DOOR HINGE ASSEMBLY

[75] Inventor: Charles J. Herman, Ellettsville, Ind.

[73] Assignee: General Electric Company, Louisville, Ky.

[21] Appl. No.: 735,330

[22] Filed: Oct. 26, 1976

[51] Int. Cl.[2] ..... E05D 7/04

[52] U.S. Cl. ..... 16/134; 16/160; 49/388

[58] Field of Search ..... 16/129–134, 16/160; 49/381, 388

[56] References Cited

U.S. PATENT DOCUMENTS

| | | | |
|---|---|---|---|
| 1,255,100 | 1/1918 | McQueen | 16/160 |
| 3,646,635 | 3/1972 | Stermac | 16/129 |
| 3,662,493 | 5/1972 | Foltz | 16/134 X |
| 3,683,453 | 8/1972 | McLeland et al. | 16/134 X |
| 3,895,412 | 7/1975 | Johnson | 49/388 X |

FOREIGN PATENT DOCUMENTS

| | | | |
|---|---|---|---|
| 937,993 | 1/1956 | Germany | 16/132 |
| 158,624 | 4/1940 | Germany | 16/160 |
| 836,151 | 4/1952 | Germany | 16/132 |
| 150,243 | 1/1932 | Switzerland | 16/160 |

*Primary Examiner*—James Kee Chi
*Attorney, Agent, or Firm*—Francis H. Boos

[57] ABSTRACT

A vertically adjustable lower hinge assembly for a center-hung door, such as for use on a refrigerator or freezer. The lower hinge assembly is adjustably fastened to the door frame. Beneath the lower hinge assembly is an adjustable support member in the form of a cam plate that is also fastened to the door frame. The support member is used for raising or lowering the lower hinge assembly, and in turn changing the elevation of the door. The support member also reinforces the holding power of the fasteners of the lower hinge assembly.

1 Claim, 3 Drawing Figures

VERTICALLY ADJUSTABLE DOOR HINGE ASSEMBLY

BACKGROUND OF THE INVENTION

1. Field of the Invention

This invention relates to a vertically adjustable door hinge assembly as for use on refrigerator cabinets to obtain proper alignment of the door.

2. Description of the Prior Art

Door hinges have been provided before with cam members for raising or lowering the door with respect to a fixed hinge as is shown in the Hedges U.S. Pat. No. 593,472, which issued Nov. 9, 1897. In this patent, a cam lifts the door for normal free use. The cam may be lowered so that the door may be lowered for better sealing when desired.

Light-weight doors for sheet metal lockers have been provided with adjusting screws for raising or lowering the door, as is shown in the Bales U.S. Pat. No. 2,364,612, which was issued Dec. 12, 1944.

A pivoted door of the center-hung type may be adjusted vertically by means of adjusting screws that extend through the edge of the door so that the vertical adjustment of the door may be accomplished while the door is hung in a pivotal position from the door frame. This is taught in the Adedon et al U.S. Pat. No. 3,114,942, which issued Dec. 24, 1963.

A similar patent with an adjustable center-hung door pivot is the Bejarano U.S. Pat. No. 3,325,942, which issued June 20, 1967.

Adjustable hinges have been provided for doors that include cam members for adjusting the relative position of the door with respect to the hinged plate to compensate for shrinking, swelling, sagging, or warping of hinged doors. Such a design is shown in the Vanderveld U.S. Pat. No. 974,451, which issued Nov. 1, 1910.

Another design of a door has adjustable hinges with cam members that cooperate with a hinge plate so the door may be adjusted after it has been hung. This is shown in the Koliha U.S. Pat. No. 1,174,326, which issued on Mar. 7, 1916.

SUMMARY OF THE INVENTION

The present invention, in accordance with one form thereof, relates to a hinge assembly for a pivoted door of the center-hung type that is supported from the front of the door frame. There is a first pair of hinge brackets fastened to the door frame adjacent the upper and lower edges of the door and a second pair of complementary hinge means fastened to the upper and lower edges of the door, and a vertically arranged hinge pin extends between each hinge bracket and its complementary hinge means. A vertically adjustable fastening means is used for holding the lower hinge bracket to the door frame. Also, there is an adjustable support member fastened to the door frame for engaging the lower hinge bracket. The elevation of the door may be altered by adjusting the position of the adjustable support member with respect to the lower hinge bracket.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENT

Figure 1:
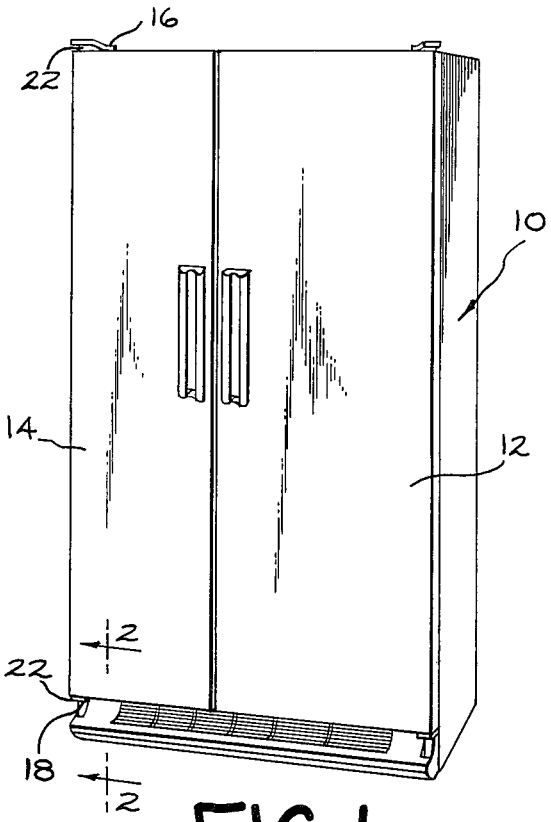
FIG. 1 is a front perspective view of a two-door refrigerator/freezer, where at least one door has a lower hinging means for changing the vertical elevation of that door so as to align that door with the adjacent door.

Turning now to a consideration of the drawings, and in particular to FIG. 1, there is shown a household two-door refrigerator/freezer cabinet 10 having a large front door 12 at the right side for gaining access to the fresh food compartment (not shown), and a smaller left-hand door 14 for gaining access to the freezer compartment (also not shown).

As is conventional in the refrigerator art, refrigerator doors are supported for side-swinging action by a first pair of hinge brackets 16 and 18 that are fastened adjacent the front face of the door frame of the refrigerator cabinet 10 as well as adjacent the upper and lower edges of the door. There is a pin-receiving thimble 22 in the upper and lower edges of the door, as is best understood from FIG. 2. A vertically arranged hinge pin 24 couples the hinge bracket 18 to the thimble 22 so that the door may pivot with respect to the hinge bracket about the vertical pivotal axis created by the alignment of the upper and lower hinge pins.

Figure 2:
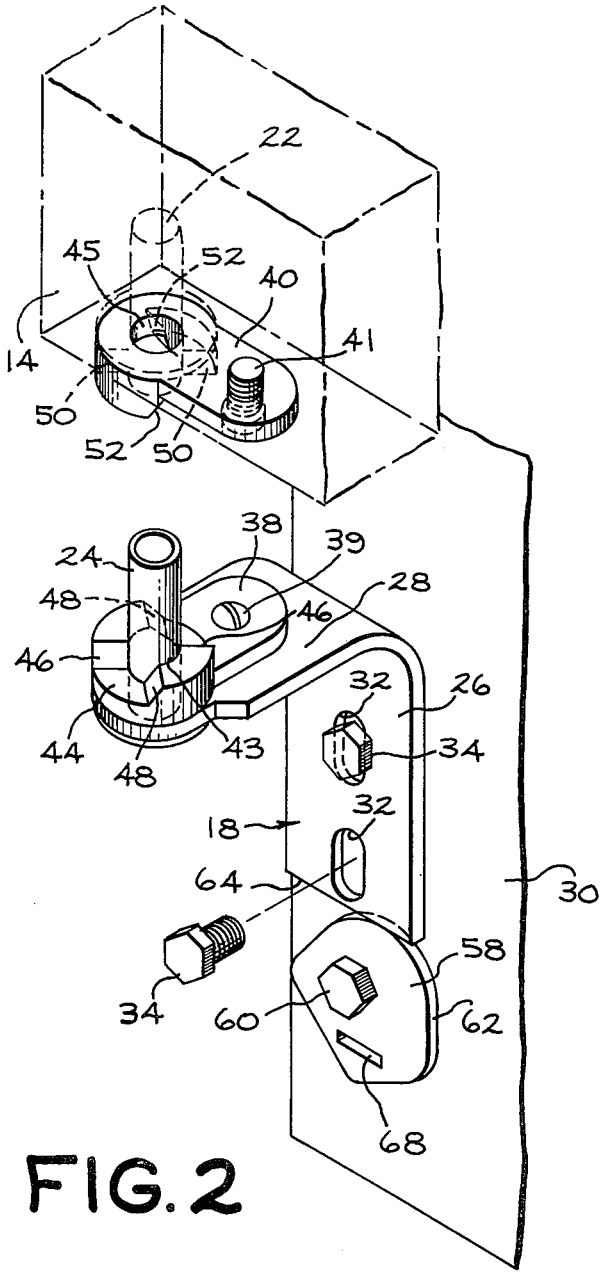
FIG. 2 is a fragmentary exploded view, on an enlarged scale, taken on the line 2—2 of FIG. 1, showing the lower hinging means for the left-hand door, and the vertically adjustable fastening means for the lower hinge bracket and the adjustable cam plate located under the lower hinge bracket and supported from the door frame and engaging the lower edge of the lower hinge bracket.

The present invention is primarily concerned with the design of an adjustable hinging means at the lower edge of a door; hence, attention will now be given to the fragmentary exploded perspective view of FIG. 2. The hinge bracket 18 is an angular member having a vertical mounting surface 26 and a generally horizontal door-supporting surface 28 at the top of the mounting surface 26. This lower hinge bracket 18 is adapted to be fastened to the front face 30 of the refrigerator cabinet 10 by means of an elongated slot and bolt combination 32 and 34. There are two such slot and bolt combinations, and the two slots 32 are arranged in a vertical plane so as to obtain vertical adjustability of this hinge bracket 18.

A pair of cam straps 38 and 40 are located between the hinge bracket 18 and the hinge thimble 22 to assist in closing the door 14, as the door approaches the fully-closed position. These two cam straps 38 and 40 do not represent part of the present invention as they are well known components used on present-day refrigerators. The first cam strap 38 is fastened by screw 39 on the horizontal surface 28 and it is generally perpendicular to the front face 30 of the cabinet, while the second cam strap 40 is fastened by screw 41 to the bottom edge of the door in a manner generally parallel with the same front face 30. Thus, the two cam straps 38 and 40 are designed to be perpendicular to each other when the door is in its fully-closed position. Each cam strap 38 and 40 is also provided with a circular hole 43 for receiving one end of the hinge pin 24. Centered around hole 43 and 45 in two of the opposite quarters of a circular area surrounding the hole 43 is a recession 44 with upwardly and outwardly inclined cam faces 46 and 48 at the two sides of the recession. The mating cam strap 40 has two complementary cam faces 50 and 52, respectively. As the door 14 is manually moved toward its closed position, the final five degrees of movement is assisted by the action of these cam surfaces 50 and 52 sliding into the recess 44 of the lower cam strap, such that the weight of the door 14 contributes to the final closing action causing the door gasket (not shown) on the inner side of the door to seal against the front face 30 of the refrigerator cabinet.

In the assembly of the doors on a two-door refrigerator, as shown in FIG. 1, it almost always happens that one door is out of vertical alignment with the other door. This is highly undesirable from an esthetic point of view, and in some cases it might contribute to poor door gasket sealing action. In any event, means must be provided to correct this in the factory in a permanent manner so that an adjustment need not be made at the time the refrigerator is uncrated at the customer's site and installed in the kitchen. Should the vertical alignment nevertheless be disturbed following factory adjustment, a means for convenient readjustment in the field is provided by the present invention.

Positioned beneath the lower hinge bracket 18 is an adjustable support member 58 in the form of a cam plate that is bolted to the front face 30 of the refrigerator cabinet by means of a through-bolt 60. This cam plate 58 has a peripheral cam surface 62 that is designed to be in engagement with the lower edge 64 of the hinge bracket 18. This cam surface 62 is designed to have a changing radius measured from the center of the through-bolt 60. Thus, in order to lower the hinge bracket 26, the cam plate 62 would be turned clockwise, while to raise the hinge bracket the cam plate would be turned counterclockwise, as is clear from FIG. 2.

It will be understood by those skilled in this art that in order to adjust the vertical position of the door 14 the fastening bolts 34 that extend through the elongated slots 32 of the lower hinge bracket 26 must be loosened first. It is also well to provide the cam plate 58 with a tool-receiving means such as a screwdriver blade-receiving slot 68 so that the assembler could apply leverage to the cam plate 58 by use of a screwdriver blade fitted into the slot 68. Of course, there are many other means available for engaging a tool with the cam plate in order to assist in providing turning action to the cam plate. Another modification would be a turned-out flange (not shown) which would be grasped by a pair of pliers for turning the cam plate.

Figure 3:
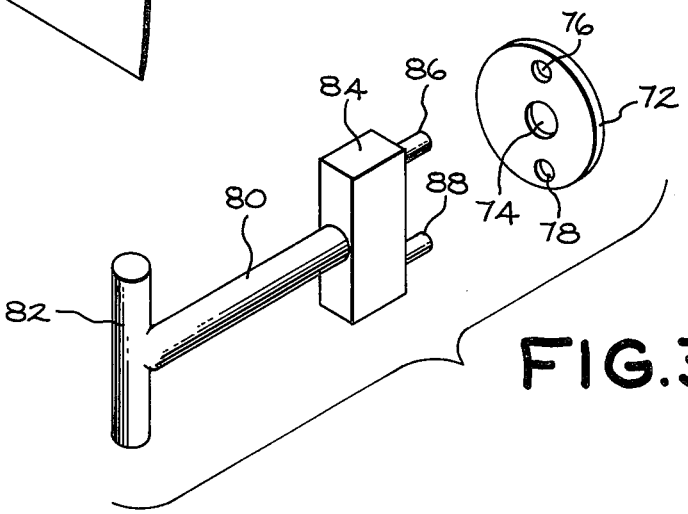
FIG. 3 is a fragmentary exploded view showing a second modification of an adjustable cam plate for acting against the lower hinge bracket, and it also shows a special wrench that mates with this second cam plate for obtaining a mechanical advantage for turning the cam plate and thereby raising or lowering the left-hand door.

Another modification of cam plate is shown in FIG. 3 as element 72. This cam plate 72 has an off-center hole 74 for receiving the through-bolt 60 for attaching the cam plate to the front face 30 of the refrigerator cabinet. A pair of diametrically opposite holes 76 and 78 are formed with relation to the bolt hole 74. A special tool or wrench 80 is shown having a handle portion 82 and a head 84 with a pair of parallel fingers 86 and 88 which are long enough so that the head 84 does not interfere with the through-bolt 60 when the fingers 86 and 88 fit into the holes 76 and 78 respectively. Thus, this tool 80 is a special wrench for engaging the cam plate 72 and providing a twisting action for raising the lower hinge bracket or lowering it, depending on whether the door 14 needs adjustment in order to be aligned with the adjacent door 12.

Having described above the invention of several modifications of adjustable cam plates in cooperation with the lower hinge bracket of a center-hung door for use on a cabinet such as a refrigerator cabinet, it will be readily apparent to those skilled in the art that the cam plate not only serves to adjust the position of the lower hinge bracket, but it also serves as an additional supporting means for the lower hinge bracket. The reason that this is important is that the adjustable fastening screws 34 cooperate with the elongated slots 32 in the lower hinge bracket, and this is not as positive a fastening means as if these bolts 34 were to fit through close-fitting holes. In other words, a great deal of the supporting of the lower hinge bracket 18 is by means of the heads of the fastening bolts 34, rather than the shank of those bolts. In order to make up for this loss in holding force, the adjustable cam plate 58 or 72 serves as an additional supporting means. Thus, when the door 14 is properly in position, the fastening screws 34 and 60 are tightened so that no further movement of the door hinges will take place in shipment or in use.

Modifications of this invention will occur to those skilled in this art; therefore, it is to be understood that this invention is not limited to the particular embodiments disclosed, but that it is intended to cover all modifications which are within the true spirit and scope of this invention as claimed.

What is claimed is:

1. In a hinge assembly for a door of the center-hung type having a vertical door frame with a door opening therein, a door mounted for pivotal movement on the door frame and adapted to close the door opening, a first pair of hinge brackets fastened to the door frame adjacent the upper and lower edges of the door, a second pair of complementary hinge means fastened to the door adjacent the hinge brackets, and vertically arranged hinge pin means between each hinge bracket and its complementary hinge means so the door may pivot with respect to the hinge brackets; the improvement comprising:

vertically adjustable slot and bolt means for securely fastening the lower hinge bracket to the door frame; and a rotatable cam plate having a peripheral cam face in engagement with the underside of the lower hinge bracket, having tool-receiving means to permit leverage to be applied to rotate the cam plate, and having an adjustable means for securely fastening the cam plate to the door frame in any position, whereby said rotatable cam plate serves to adjust the position of the lower hinge bracket and additionally reinforces the holding power of said slot and bolt means.

* * * * *